United States Patent [19]

Elkins

[11] 4,082,266

[45] Apr. 4, 1978

[54] ELECTRICAL MOTOR POWERED JUMP ROPE APPARATUS

[75] Inventor: Nate Elkins, Alhambra, Calif.

[73] Assignee: The Raymond Lee Organization, Inc., New York, N.Y.

[21] Appl. No.: 718,782

[22] Filed: Oct. 5, 1976

[51] Int. Cl.[2] ..... A63B 5/20

[52] U.S. Cl. ..... 272/75

[58] Field of Search ..... 272/74, 75, 1 B

[56] References Cited

U.S. PATENT DOCUMENTS

| | | | |
|---|---|---|---|
| 104,674 | 6/1870 | Whitehead | 272/74 |
| 259,440 | 6/1882 | Turnbull | 272/74 |
| 3,013,798 | 12/1961 | Willoughby | 272/74 |
| 3,061,307 | 10/1962 | Burr | 272/75 |
| 3,363,898 | 1/1968 | Crovello | 272/75 |
| 3,612,522 | 10/1971 | Ekonen | 272/75 |

FOREIGN PATENT DOCUMENTS

| | | | |
|---|---|---|---|
| 408,300 | 1/1910 | France | 272/75 |
| 11,098 of | 1905 | United Kingdom | 272/74 |

*Primary Examiner*—Richard C. Pinkham
*Assistant Examiner*—Arnold W. Kramer
*Attorney, Agent, or Firm*—Howard I. Podell

[57] ABSTRACT

An electrical jump rope apparatus which revolves a loop or rope about a horizontal shaft to enable a user to jump as the rope loop revolves. The apparatus includes a stand fitted with a telescopic vertical support arm, the length of which is adjustable, with a motor fixed to the support arm and spur wheels fixed to the motor shaft and spaced apart from each other by a tube fitted with bearings to freely revolve about the shaft. In use, the player grips the tube, as he jumps through the revolving loop of rope.

1 Claim, 3 Drawing Figures

ELECTRICAL MOTOR POWERED JUMP ROPE APPARATUS

SUMMARY OF THE INVENTION

My invention is an electrical jump rope apparatus which revolves a loop or rope about a horizontal shaft to enable a user to jump as the rope revolves. The apparatus includes a stand fitted with a telescopic vertical support arm, the length of which is adjustable, with a motor fixed to the top of the support arm with the motor shaft extending in a horizontal plane from the stand. Each end of a length of rope, forming a loop, is fixed to a spur wheel fixed to the motor shaft and spaced apart from each other by a tube fitted with bearings to freely revolve about the shaft. In use, the player grips the tube, as he jumps through the revolving loop of rope.

My invention may be employed in classrooms in schools to provide excercise to the students.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
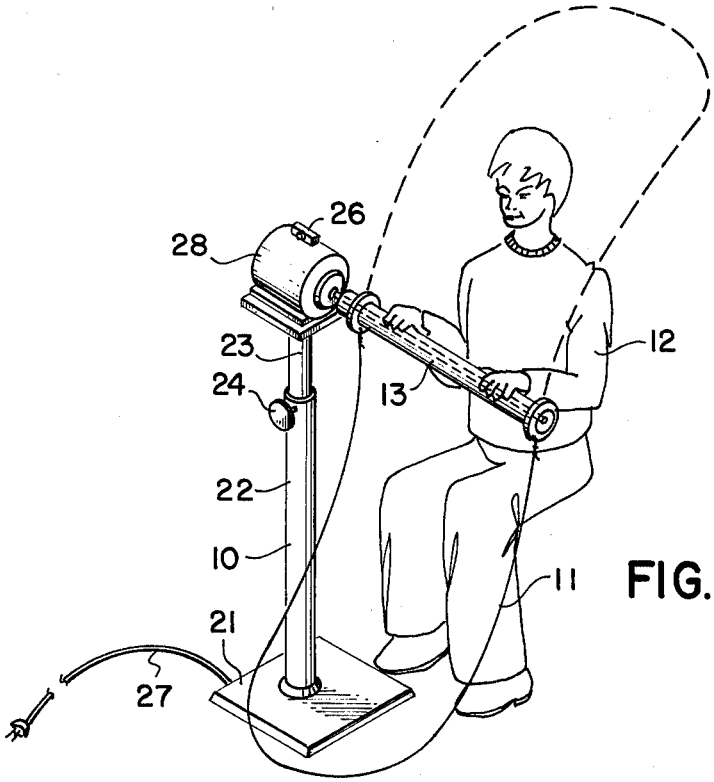
FIG. 1 is a perspective view of the apparatus in use.
Figure 2:
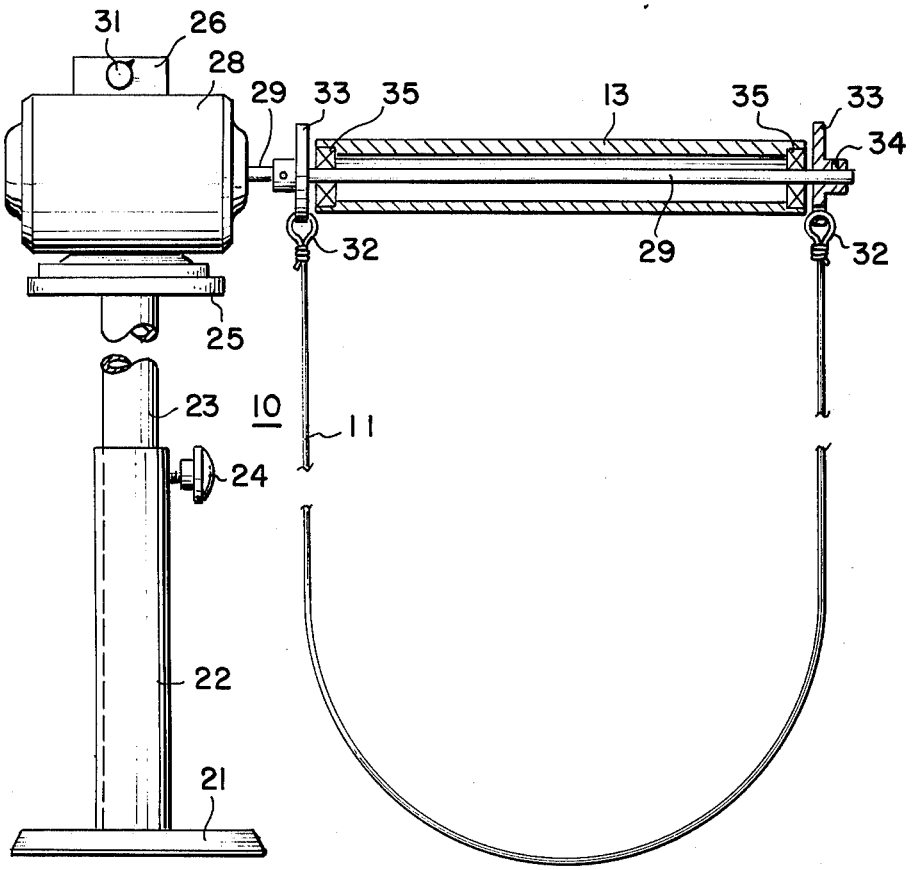
FIG. 2 is a side sectional view of the apparatus.

Turning now descriptively to the drawings, in which similar reference characters denote similar elements throughout the several views, FIGS. 1–2 illustrate the jump rope apparatus 10 which rotates a loop 11 of flexible rope so that the user 12, manually grasping a horizontal tube 13 may jump through the loop 11 as it revolves about the axis of tube 13.

The apparatus 10 is formed with a base plate 21 fixed to a vertical support tube 22 in which a telescopic tube section 23 is fixed in place by a thumb screw 24 threaded to the wall of support tube 22. A support plate 25 on the free upper end of the tube section 23 is fastened to a motor 28 oriented with the motor 28 driving unit drive shaft 29 in a horizontal plane, in the installed position. A portable electrical line cord 27 extends through the tubes 22 and 23 to motor 28. A speed control unit 26 operated by a rotatable knob 31 is mounted externally to the housing of the motor 28.

The drive shaft 29 of the unit extends horizontally beyond the motor 28, being joined to the motor shaft (not shown) of the motor 28 by a friction clutch 41. Friction clutch 41 releases unit drive shaft 29 from engagement with the motor shaft when rope loop 11 becomes caught or entangled, in use. Each end 32 of the rope loop 11 is fixed to an individual spur wheel, 33 separated by a tubular gripping sleeve 13 fixed to freely revolve about shaft 29 by internal bearings 35.

Figure 3:
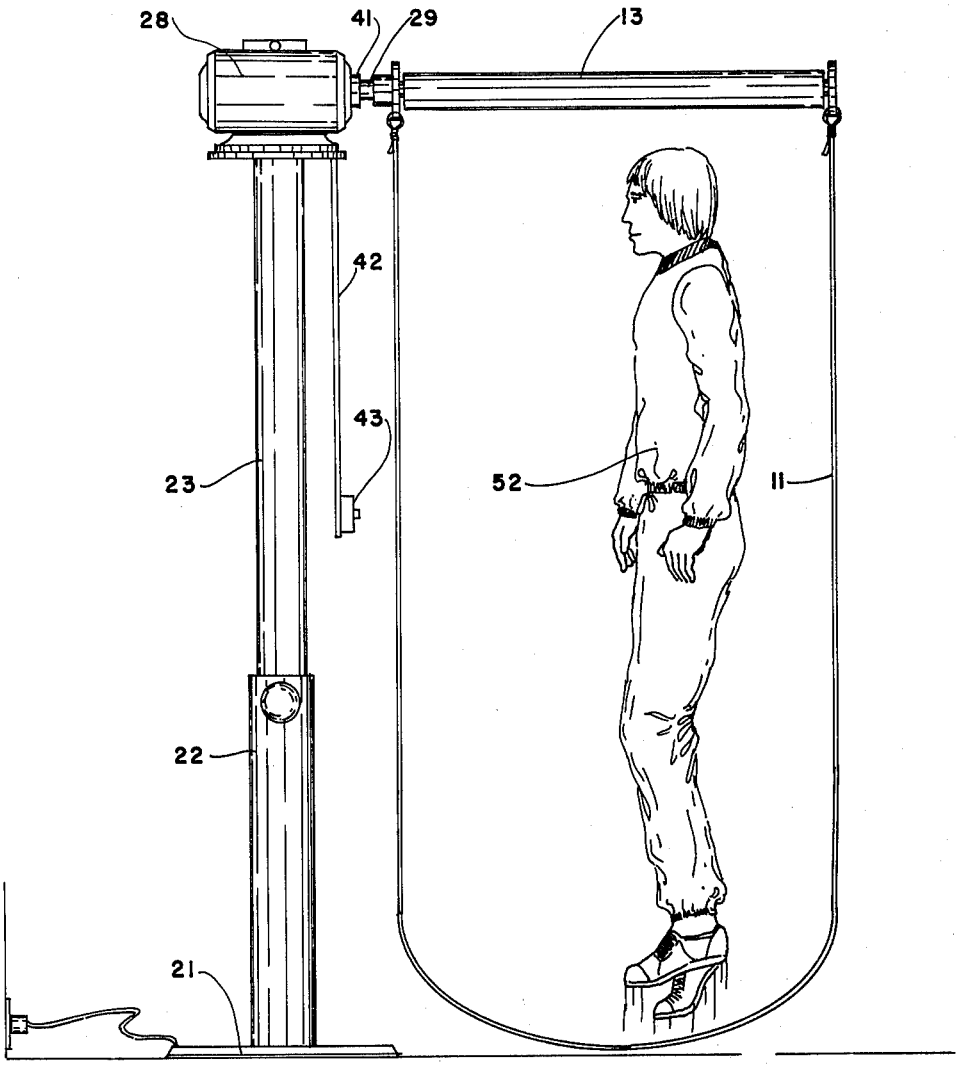
FIG. 3 is a perspective view of the apparatus extended for an alternate use.

As shown in FIG. 3, the telescopic tube section 23 may be extended in height so that unit drive shaft 29 and sleeve 13 is above the head of the user 52 to permit the user to jump through the loop 11, in operation, without the user grasping sleeve 13.

As shown in FIGS. 1–3, an electrical switch 43 may extend from a semi-flexible cable 42 which encloses electrical wires leading to motor 28 to stop motor 28 when switch 43 is actuated.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A powered jump rope apparatus comprising a vertical member adapted to be supported on a horizontal surface, a stand carried by said vertical member, a motor mounted on said stand, said motor having an output drive shaft extended externally therefrom, and means to attach each of two ends of a flexible cable to the external section of the drive shaft, said means separated by a sleeve mounted over the drive shaft so as to freely rotate about the said shaft, said sleeve being of an external diameter to be grasped by the hands of a person using the apparatus.

* * * * *